US006270386B1

(12) United States Patent
Visocekas

(10) Patent No.: US 6,270,386 B1
(45) Date of Patent: Aug. 7, 2001

(54) AVALANCHE LIFE-PRESERVING JACKET WITH AIRBAG

(75) Inventor: Ariel Remy Visocekas, San Francisco, CA (US)

(73) Assignee: Avagear Inc., San Francisco, CA (US)

( * ) Notice: Subject to any disclaimer, the term of this patent is extended or adjusted under 35 U.S.C. 154(b) by 0 days.

(21) Appl. No.: 09/056,181

(22) Filed: Apr. 6, 1998

Related U.S. Application Data

(60) Provisional application No. 60/064,870, filed on Nov. 5, 1997.

(51) Int. Cl.[7] ..... B63C 9/125; A62B 37/00

(52) U.S. Cl. ..... 441/80; 441/89; 441/92; 441/104; 441/124

(58) Field of Search ..... 441/80, 88, 89, 441/91–93, 94, 96, 104, 106, 114–119, 121, 123

(56) References Cited

U.S. PATENT DOCUMENTS

| | | | | |
|---|---|---|---|---|
| 3,362,034 | * | 1/1968 | Oldham . | |
| 4,114,561 | | 9/1978 | Asaro . | |
| 4,272,857 | | 6/1981 | Oldham . | |
| 4,365,628 | | 12/1982 | Hodel . | |
| 4,498,882 | * | 2/1985 | Evert | 441/116 |
| 4,500,014 | | 2/1985 | Zimmerly . | |
| 4,551,106 | | 11/1985 | Prager . | |
| 4,635,754 | | 1/1987 | Aschauer et al. . | |
| 4,685,890 | | 8/1987 | Edwards . | |
| 4,753,621 | | 6/1988 | Lucas et al. . | |
| 4,865,573 | | 9/1989 | Switlikk, Jr. et al. . | |
| 4,887,987 | | 12/1989 | Kato . | |
| 5,162,006 | * | 11/1992 | Yandle, II | 441/96 |
| 5,245,943 | * | 9/1993 | Hull et al. | 441/123 |
| 5,500,952 | * | 3/1996 | Keyes | 441/93 |
| 5,547,149 | * | 8/1996 | Kalberer et al. | 244/121 |
| 5,603,647 | | 2/1997 | Van Adrichem et al. . | |
| 5,692,933 | | 12/1997 | Bradley et al. . | |

FOREIGN PATENT DOCUMENTS

| | | |
|---|---|---|
| 2326850 | 12/1974 | (DE) . |
| 19516872 | 11/1996 | (DE) . |
| 723790 | 7/1996 | (EP) . |
| 2162129 * | 1/1986 | (GB) . |

* cited by examiner

*Primary Examiner*—Sherman Basinger

(57) ABSTRACT

An avalanche life jacket having an airbag inflatable by a gas release system upon actuation is disclosed. The life jacket provides a torso strap and buckles for attaching the life jacket to the user. Prior to inflation, the airbag is folded and enclosed within the harness. The harness encloses the airbag via an enclosure mechanism which opens during inflation of the airbag to allow the airbag to fully expand. The life jacket further comprises a gas release system which may be automatically actuated by an accelerometer and/or manually actuated by the user's pulling of a release handle. Upon actuation, the gas release system releases gas into and inflates the airbag. The airbag inflates to surround at least the back and sides of the user's head to thereby provide physical protection and a thermal buffer between a portion of the user and the external environment, for example, during and after an avalanche and to facilitate search and rescue of the user after the avalanche. The inflated airbag also provides a buoyant force against the downward force exerted by the current of the avalanche as well as a supply of breathable gas. A hood or mesh is also included to shield the user from the external elements such as snow and thereby facilitate in preventing injury and/or suffocation during a fall or an avalanche.

30 Claims, 9 Drawing Sheets

AVALANCHE LIFE-PRESERVING JACKET WITH AIRBAG

CROSS-REFERENCE TO RELATED APPLICATIONS

The present application claims priority to Provisional Patent Application No. 60/064,870 entitled "Avalanche Life Jacket" filed on Nov. 5, 1997.

FIELD OF THE INVENTION

The present invention relates to an avalanche life jacket. Specifically, the present invention relates to an avalanche life jacket having an airbag inflatable by a gas release system upon actuation by a user. The airbag inflates around at least the user's head to protect the user's head during an avalanche and to facilitate search and rescue of the user after the avalanche.

BACKGROUND OF THE INVENTION

One type of personal emergency life preserving equipment designed to be worn and utilized by a specific user is life jackets. Certain life jackets comprise inflatable balloons as an additional life preserving feature. The balloon may be inflated upon actuation in the event of an emergency. One example of a life jacket with an inflatable balloon is disclosed in U.S. Pat. No. 4,635,754 to Aschauer et al. ("Aschauer"). Aschauer discloses a rescue apparatus that includes a balloon bound to a frame securable to a user. The apparatus comprises a rigid frame with a collar to which the filling opening of the balloon is attached. A balloon filling mechanism and the balloon are disposed within the frame for the stated purposes of functional safety during release, balloon inflation and actual and repeated use. Aschauer discloses that the balloon is inflated by pressurized gas to buoy the attached person at the surface of the avalanche.

Other types of personal emergency life preserving equipment also may be worn and utilized by a specific user. For example, U.S. Pat. No. 4,551,106 to Prager ("Prager") discloses a life preserving equipment designed to be worn by a user on or in the water. The life preserving equipment comprises a rigid elongated housing having a hinged cover. The housing encloses an inflatable member which in turn encloses a gas release system. The gas release system comprises a compressed gas cartridge with a diaphragm, a cartridge puncturing pin, and a cooperating lever. Upon opening the hinged cover, levers carried by the housing and the cover actuate a cooperating lever to force the puncturing pin into the diaphragm of the gas cartridge. Upon puncturing the diaphragm, the gas cartridge discharges the gas contained therein into the inflatable member to thereby inflate the member. During inflation of the member, the inflatable member exits the housing and is tethered to the housing via a cord coupled therebetween.

In both life preserving equipment described above, the balloon, upon inflation, does not surround the user's head and thus does not provide physical protection to the user's head. For example, the balloon does not provide a buffer between the user's head and any potential danger such as falling rocks in the event of an emergency such as an avalanche.

In addition, conventional life preserving equipment are usually large and bulky and relatively expensive. Further, neither of the above references describe a life preserving equipment having automatic actuation upon detection of an emergency such that the balloon would be inflated even if a user neglects to manually actuate the equipment.

SUMMARY OF THE INVENTION

In view of the foregoing problems and disadvantages of convention life preserving equipment, it is an object of the present invention to provide a life preserving jacket comprising an inflatable balloon or airbag which, upon inflation, provides a buffer between at least the user's head and any potential dangers posed to the user in the event of an emergency such as an avalanche.

It is a further object of the present invention to provide a life preserving jacket that is light weight, compact, cost effective, reliable and functionally safe prior to and during actuation, during inflation of the airbag, as well as during repeated use.

It is a yet further object of the present invention to provide a life preserving jacket comprising an automatic actuator which, upon detection of an emergency, inflates the balloon even if a user does not manually actuate the equipment.

The life preserving jacket of the present invention generally comprises a harness, a torso strap for attaching the jacket to the user, an airbag enclosed within the harness prior to inflation, and a release handle for manually actuating the gas release system to inflate the airbag. The harness provides an enclosure mechanism for enclosing the airbag within the harness and for opening to allow the airbag to expand outside of the harness during inflation. Prior to inflation, the airbag is folded inside the harness such that, upon inflation, the airbag surrounds at least the back and sides of the user's head to thereby provide a physical and thermal buffer between the user's head and the environment. The inflated airbag may also provide a buoyant force against the downward force exerted by the current of the avalanche.

An actuation preventer may be provided to selectively prevent the release handle from actuating gas release system, such as when the torso strap is not secured. In addition, an accelerometer may be provided for automatic actuation of the gas release system upon indication of a predetermined threshold acceleration. Further, a mouth-bite may be provided on the harness such that the user may breathe and/or release the gas contained in airbag after inflation. Thus, the inflated airbag may additionally serve as a respiratory chamber, for example, if the user is trapped under the snow.

DESCRIPTION OF THE INVENTION

Figure 1:
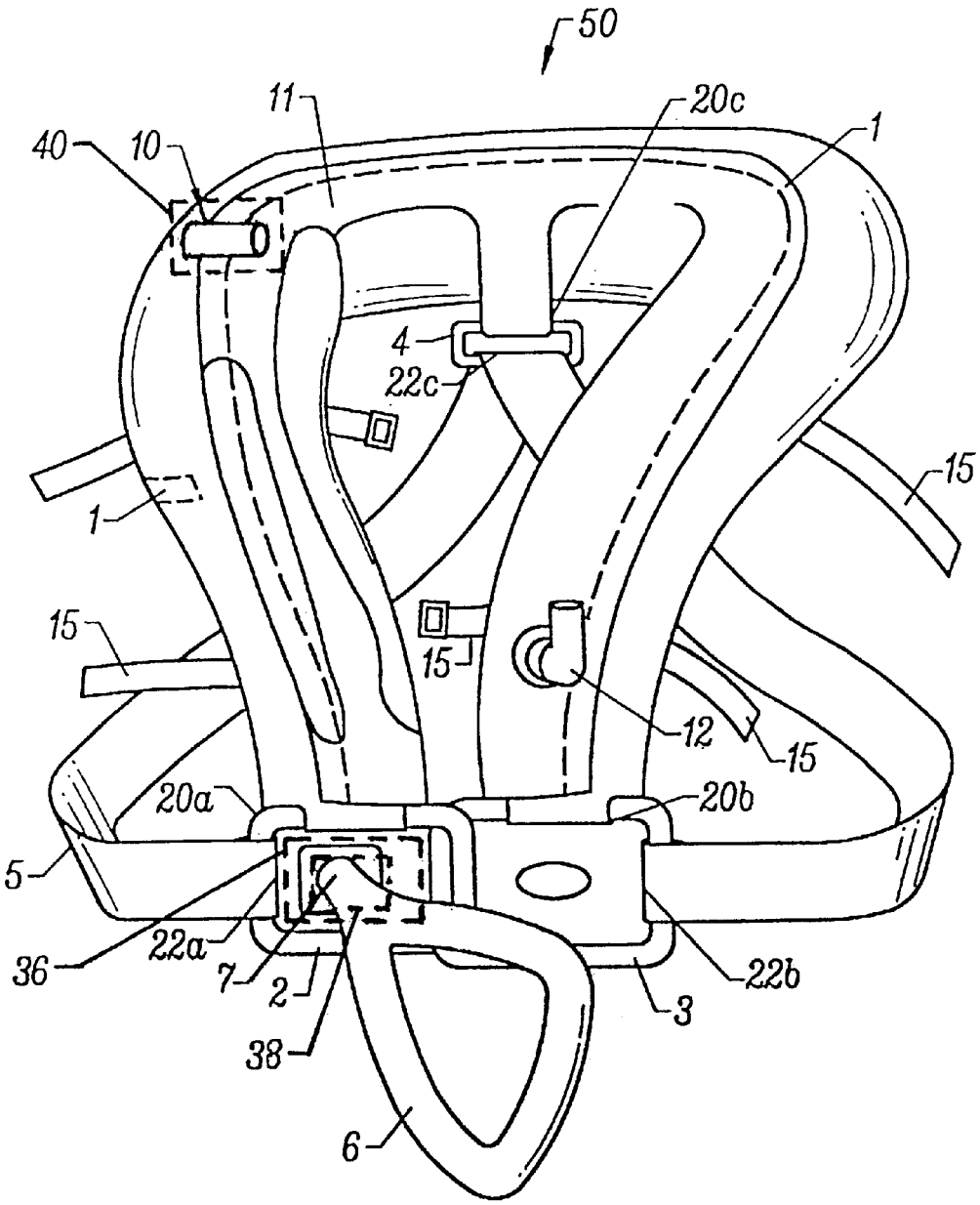
FIG. 1 shows a front perspective view of the avalanche life jacket of the present invention.

Avalanche life jacket 50 of the present invention, as shown in FIG. 1, generally comprises harness 1 enclosing non-inflated buoyant or airbag 8 (not shown), torso strap 5 for attaching jacket 50 to a user, and release 6 for actuating gas release system 10 to inflate airbag 8.

Harness 1 provides loops 20*a–c* coupled to fastening devices 2, 3, 4, respectively. Fastening devices 2, 3, 4 are further coupled to loops 22*a–c,* respectively, provided by torso strap 5. Harness 1 may be made of materials suitable for outdoor activities. Such materials are preferably mildew resistant, waterproof and rugged to withstand high winds and low temperatures. Examples of materials suitable for harness 1 include but are not limited to nylon and kevlar textile materials, for example, Cordura™. Fastening devices 2, 3 and 4 may be any suitable mechanism such as buckles and are made of materials such as aluminum, titanium, plastic, or any combination thereof.

Figure 2:
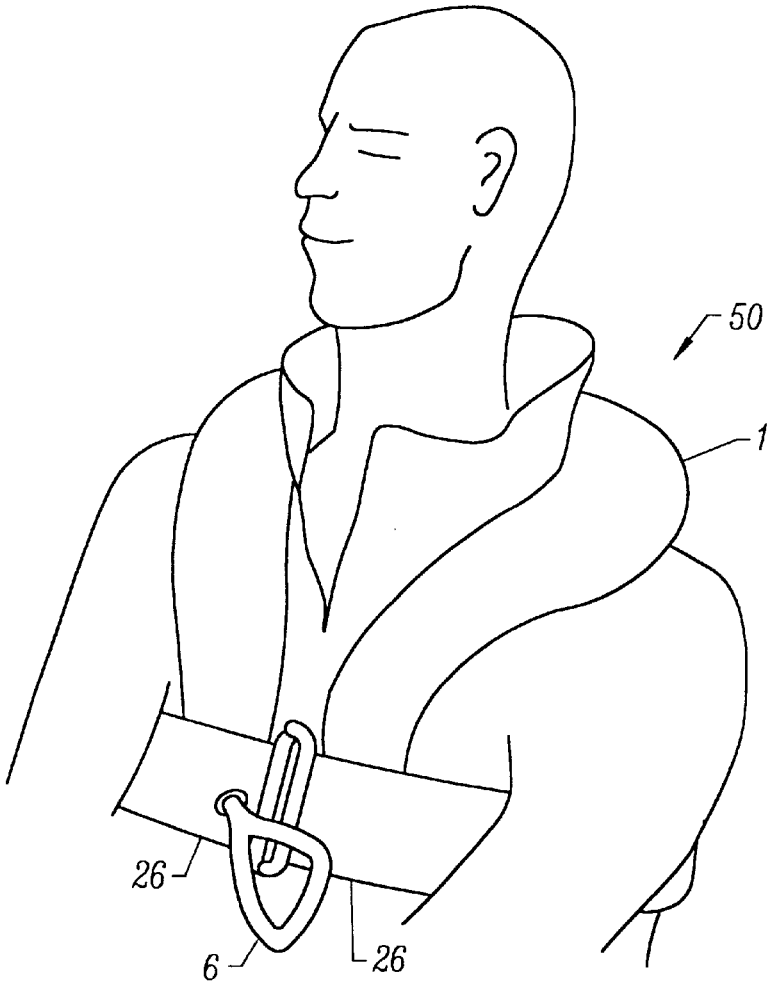
FIG. 2 shows a user wearing the avalanche life jacket of FIG. 1.
Figure 3:
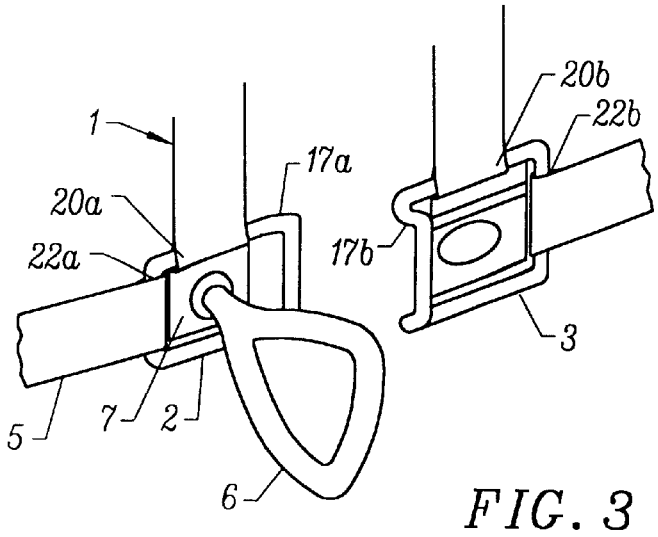
FIG. 3 shows the buckles and the handle of the avalanche life jacket of FIG. 1.

As shown in FIGS. 2 and 3, when life jacket 50 is worn by the user, torso strap 5 is firmly wrapped around the torso of the user. To secure life jacket 50 to the user, the user interlocks fasteners 17*a,* 17*b* of front buckles 2, 3, respectively, to each other. Preferably, fasteners 17*a,* 17*b* of front buckles 2, 3 have cooperating mating shapes to enable fasteners 17*a,* 17*b* to overlap and then interlock to each other.

Figure 4:
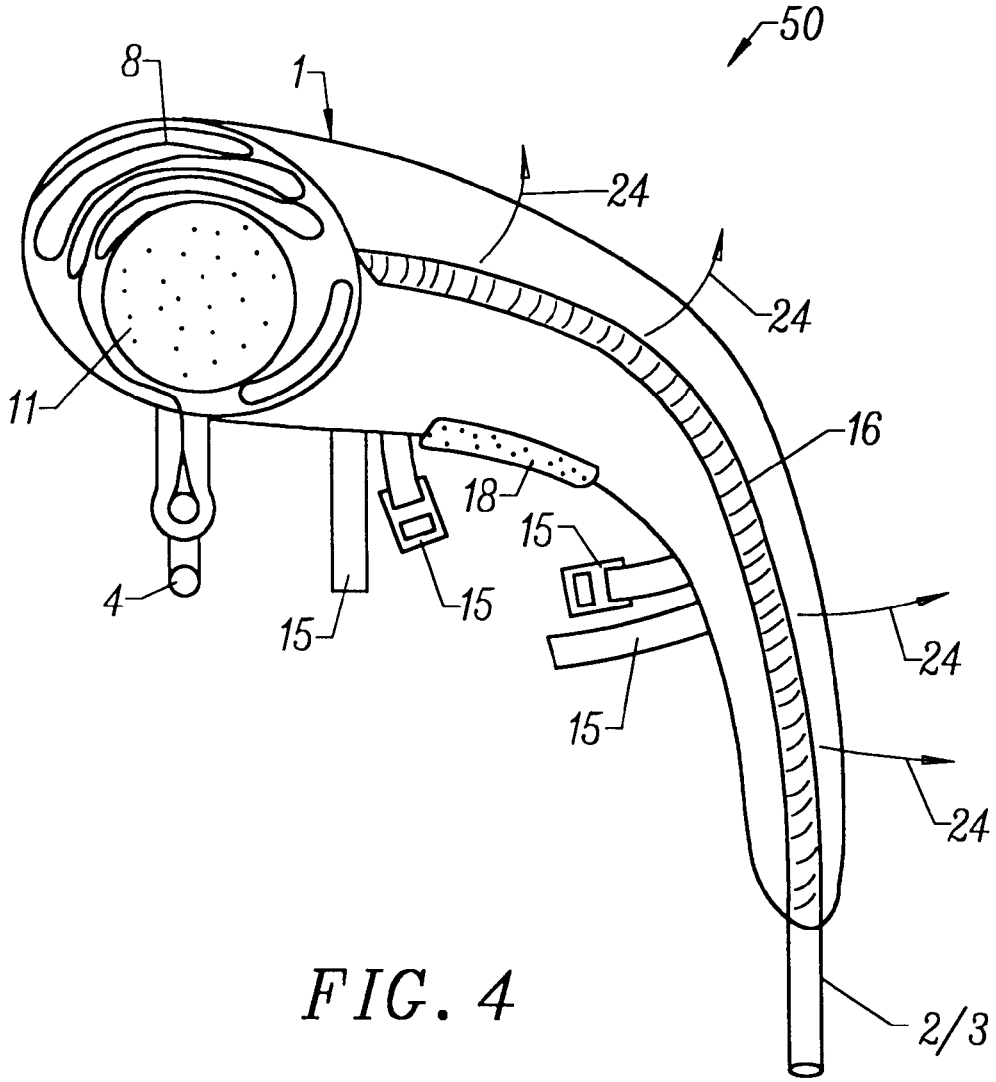
FIG. 4 shows a cut-away side view of the avalanche life jacket of FIG. 1.

FIG. 4 shows a partial cut-away side view of life jacket 50 prior to inflation of airbag 8. Airbag 8 is folded inside and enclosed within harness 1 such that airbag 8 is positioned around the user's neck and the front of the user's torso when jacket 50 is attached to the user. Such positioning allows airbag 8 to inflate around the back and sides of the user's head to protect the user's head during a fall or an avalanche. Harness 1 provides a suitable airbag enclosure mechanism 16 for enclosing airbag 8 in harness 1 to cover and protect airbag 8 prior to inflation and between multiple uses thereof. Enclosure mechanism 16 may comprise any suitable enclosure mechanism capable of opening or rupturing under pressure of an inflating airbag 8 in order to allow airbag 8 to inflate beyond the volume provided within harness 1. Examples of suitable enclosure mechanism 16 include string sewn into harness 1, snaps, buttons, clips, zipper, and, preferably, a strip of Velcro™.

During inflation, expansion of airbag 8 exerts pressure on the interior of harness 1 and airbag enclosure mechanism 16. Upon airbag 8 exerting a threshold pressure, the threshold pressure forces open airbag enclosure mechanism 16. Airbag 8 is then allowed to fully inflate in a direction indicated by arrows 24 in FIG. 4. When fully inflated, airbag 8 is disposed around at least the user's head to thereby provide a buffer between the user's head and the environment.

Airbag 8 may be made of a micro-welded material with micro-waves, heat-welded with any heat-welding techniques, or mold-pressed and mold-welded on a larger scale. The material for airbag 8 may be any nylon, PE textile coated with layers of polyurethane, polyvinylchloride (PVC), or other materials that are relatively gas impermeable. Airbag 8 is preferably made of material that is relatively difficult to puncture, resistant to mildew and is gas and liquid impermeable. For example, airbag 8 may comprise a thin, gas impermeable inner layer made of, for example, polyurethane, and protected by a thicker outer layer, such as nylon or Cordura™, that is relatively difficult to puncture. Such a dual layer construction facilitates repair of airbag 8, for example, by removing the inner layer from the outer layer to repair the inner layer. Alternatively or additionally, at least a portion of airbag 8 may be made out of materials for multiple uses and which can withstand exposure to outdoor environments such as extreme cold and moisture. These materials may include nylon, Cordura™ coated with hypalon, polyurethane, polyvinylchloride (PVC). Airbag 8 may also be made of expandable material, such as Lycra™ or Lycra-Cordura™.

As noted above and shown in FIG. 2, jacket 50 may be attached to the user by firmly wrapping torso strap 5 securely around the torso of the user. Harness 1 may further provide harness attachment mechanism 18 (shown in FIG. 4) on harness 1 to further secure jacket 50 to the user's garment. Harness attachment mechanism 18 may comprise any suitable, preferably releasable, attachment mechanism, such as Velcro™, clips, buttons, zippers, snaps, loops or buckles. The user may also utilize a special garment with a pocket or passageway 26 through which torso strap 5 may be inserted to further secure jacket 50 to the user.

Figure 5:
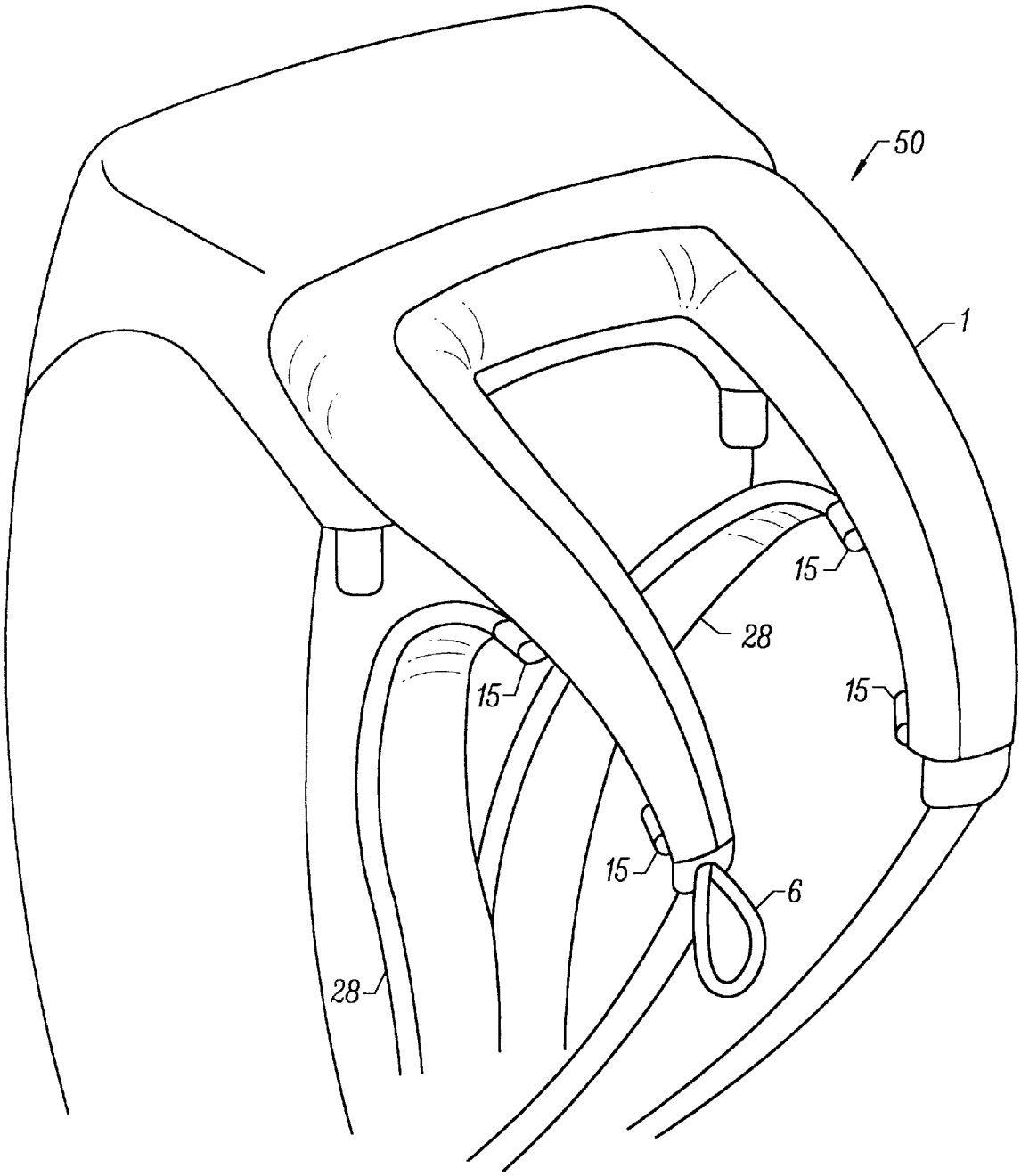
FIG. 5 shows the avalanche life jacket of FIG. 1 attached to a backpack.

Jacket 50 may also be coupled to a backpack, as shown in FIG. 5, or a garment, such as a vest, via buckles, ratches, loops and/or straps 15 provided on harness 1. In the case of a backpack, each of harness straps 15 is coupled to a front portion of a corresponding shoulder pad 28 of the backpack, i.e. the portion of shoulder pad 28 which would rest on the user's front torso. Torso strap 5 (shown in FIGS. 1 and 3) may be partially or completely detachable from buckles 2, 3 and/or 4, for example, at loops 22*a,* 22*b* and/or 22*c*. Detachability of torso strap 5 from buckles 2, 3 and/or 4 facilitates secure coupling of jacket 50 to the backpack and to the user.

Figure 6:
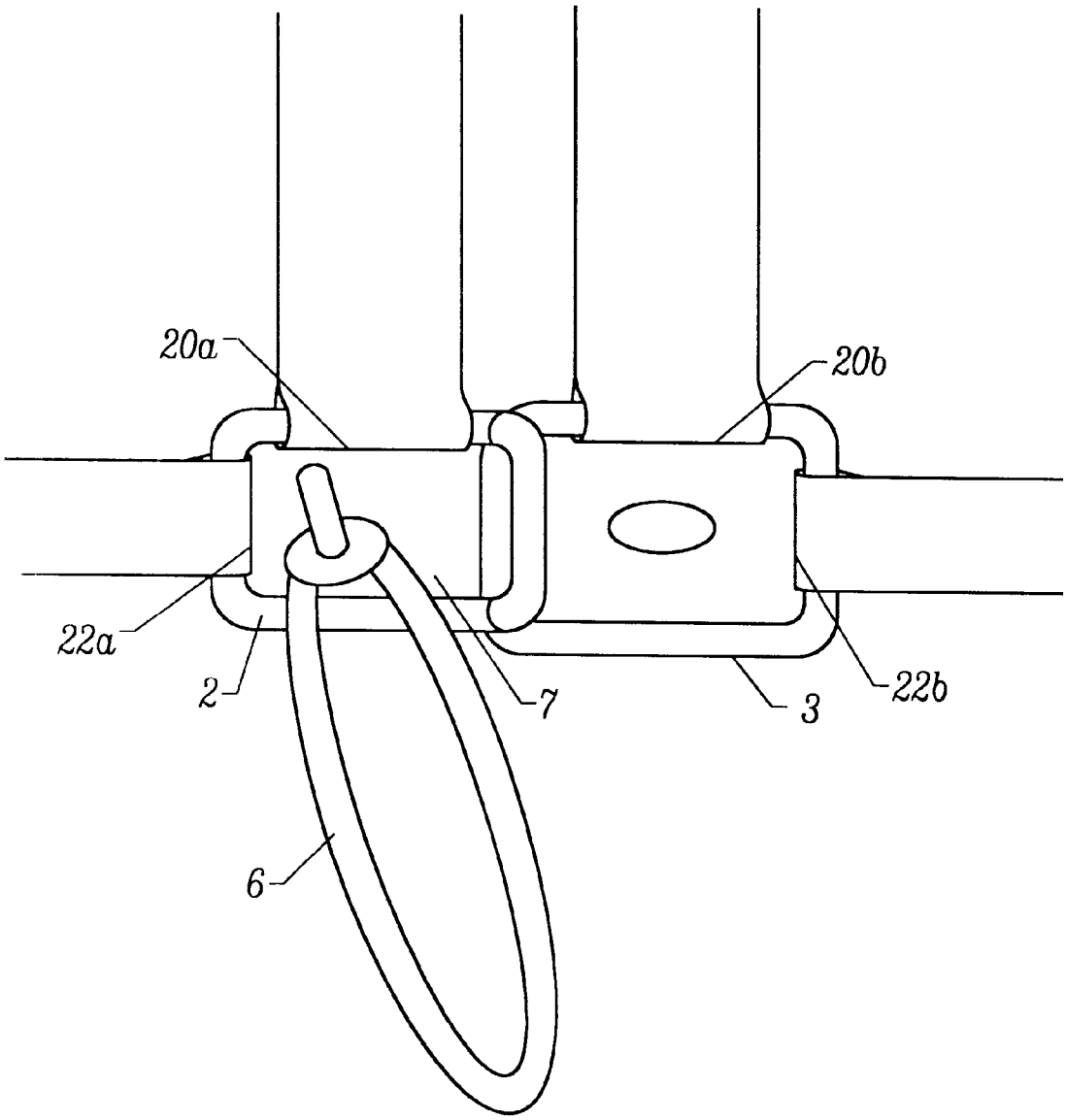
FIG. 6 shows an alternative cord handle for the avalanche life jacket of the present invention.

To inflate airbag 8 by manual actuation, such as in the event of an avalanche, the user pulls or otherwise manipulates release 6 to actuate gas release system 10. Release 6 may comprise any other suitable manual actuation mechanism, such as a handle, a button or a rip cord. Release 6 is preferably made of any suitable material which is light weight, robust and capable of withstanding extremely low temperatures in the environment. Release 6 may be made of a flexible material which can easily deform under pressure such that the user is not injured if the user falls upon release 6. For example, as shown in FIG. 6, release handle 6' may be made from a mountaineering rope buckle which may be enclosed by a clear plastic tube. Alternatively a semi-rigid plastic material may be used, such as silicon, Latex™ or polyurethane.

Figure 7A:
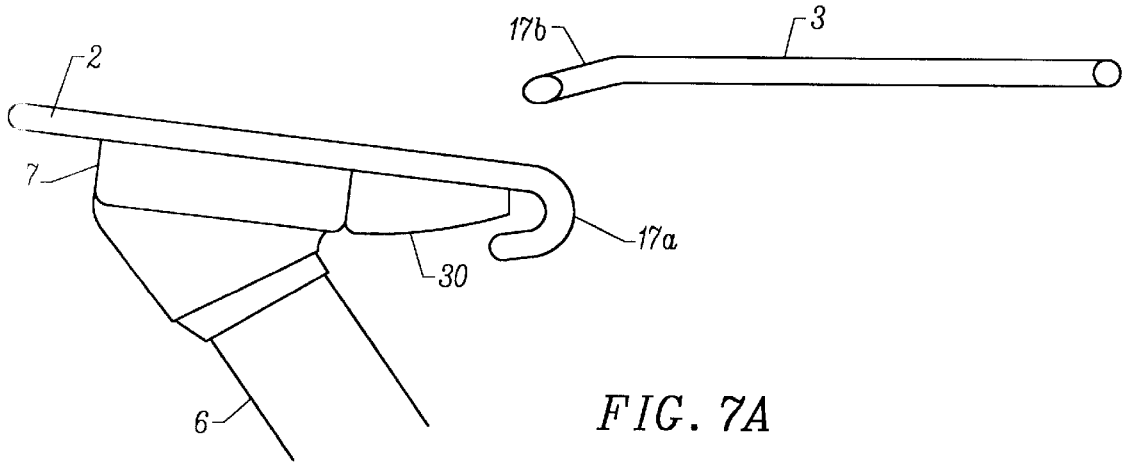
FIGS. 7A and 7B respectively show the unlocked and interlocked arrangements of the front buckles of the avalanche life jacket of FIG. 1.
Figure 7B:
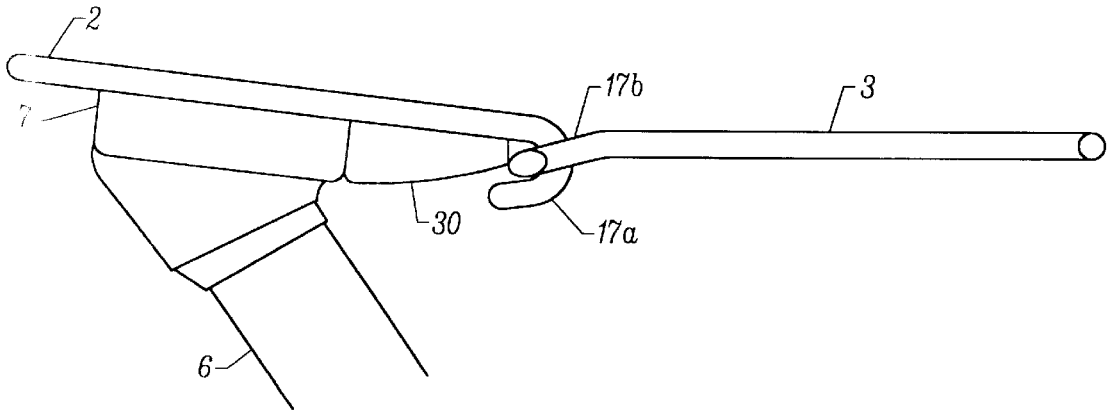

Referring now to FIGS. 7A and 7B, release handle 6 extends from and is coupled to base 7 disposed on front buckle 2. Base 7 may provide a retractable actuation preventer 30 to selectively prevent release handle 6 from actuating gas release system 10. When actuation preventer 30 is fully extended, such as when buckles 2, 3 are not interlocked as shown in FIG. 7A, actuation preventer 30 prevents release handle 6 from actuating gas release system 10. When actuation preventer 30 is retracted, such as when buckle 3 is interlocked with buckle 2 to force actuation preventer 30 to retract into base 7 as shown in FIG. 7B, actuation preventer 30 allows release handle 6 to be pulled to actuate gas release system 10.

Additionally or alternatively, airbag 8 may be inflated by automatic actuation. For example, jacket 50 may provide an accelerometer 36 to automatically actuate gas release system 10 upon detection or indication by the accelerometer 36 of a predetermined threshold acceleration. The accelerometer 36 is preferably disposed within buckle 2 at base 7 of handle 6. A user-select switch or toggle 38 may be provided, for example, at base 7 of handle 6, to allow the user to select among various actuation mechanisms. For example, the actuation mechanisms may include an off position to prevent actuation, a manual position to allow only manual actuation, an automatic position to allow only automatic actuation, and/or a manual and automatic position to allow both manual and automatic actuation. Thus when automatic accelerometer 36 actuation is available and selected and when the accelerometer 36 registers the predetermined threshold acceleration, such as when the user falls or is being swept by an avalanche, the accelerometer 36 would automatically actuate gas release system 10 to inflate airbag 8.

Figure 8:
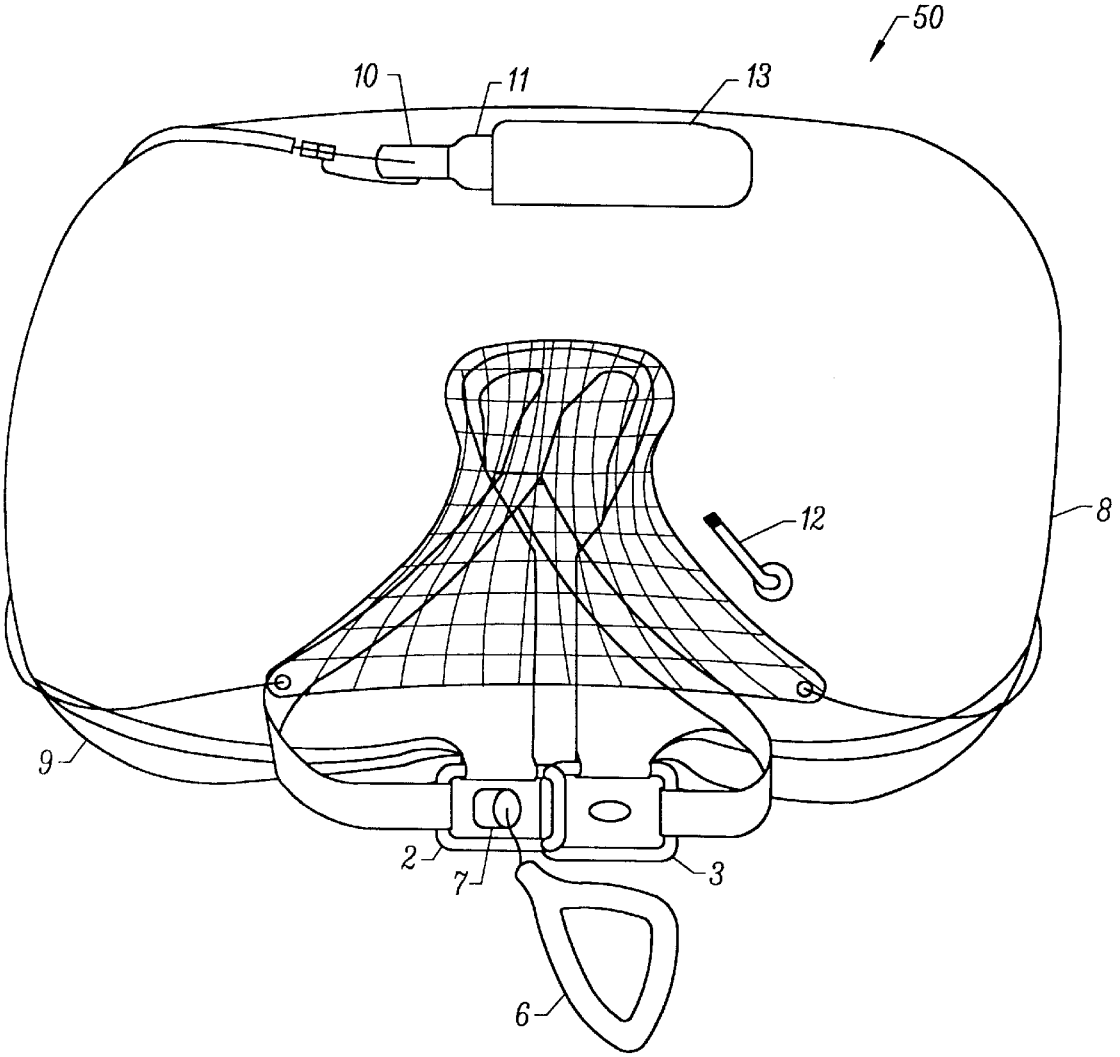
FIG. 8 shows the avalanche life jacket of FIG. 1 when inflated.

Referring now to FIG. 8, gas release system 10 and the inflation of airbag 8 will now be described in more detail. Release handle 6 and the accelerometer 36, if one is provided, are further coupled to cable and/or hose 9. Cable 9 is in turn coupled to gas release system 10. Alternatively, the accelerometer 36 may be directly coupled to and disposed on or near gas release system 10. Thus, when the user pulls release handle 6 or when the accelerometer 36 is triggered, gas release system 10 is actuated to inflate airbag 8.

Gas release system 10 may be one used for airplanes or sailing life-jackets, such as those sold by Hakley-Roberts. The gas contained by gas release system 10 may be nitrogen, oxygen, air, or mixtures thereof, depending on the specific application. Typically, inflation of airbag 8 is completed in a few seconds, preferably in approximately 2 to 6 seconds. Alternatively, gas release system 10 may be one used for car airbags, such as those manufactured by Breed Technologies, SNPE, which would provide faster gas release and would typically release gas such as sodium oxide, hydrogen, air or mixtures thereof. Preferably, the gas is one suitable for breathing.

Gas release system 10 is sealingly connected to airbag 8, via a manifold (not shown). Manifold connects gas release system 10 to airbag 8 to provide gaseous communication therebetween. Gas release system 10 comprises one or more gas cartridges 11 which is preferably disposed within one or more pockets 13 provided on an exterior surface of airbag 8. Although not preferred, gas cartridge 11 may be alternatively placed within airbag 8. Gas cartridge 11 may be disposed at any suitable location relative to airbag 8 but preferably is disposed such that prior to, during, and after inflation of airbag 8, the risk of gas cartridge 11 coming into contact with the user, especially the user's head, is minimized. Thus, the risk of gas cartridge 11 injuring the user is minimized.

To inflate airbag 8 (and, if actuation preventer 30 is provided, when front buckles 2, 3 are interlocked), the user may pull release handle 6, which in turn pulls cable 9. Cable 9 then actuates gas release system 10, for example, by piercing a membrane provided by gas cartridge 11, to release the gas contained in gas cartridge 11 into airbag 8. Airbag 8 is inflated thereby.

Figure 9:
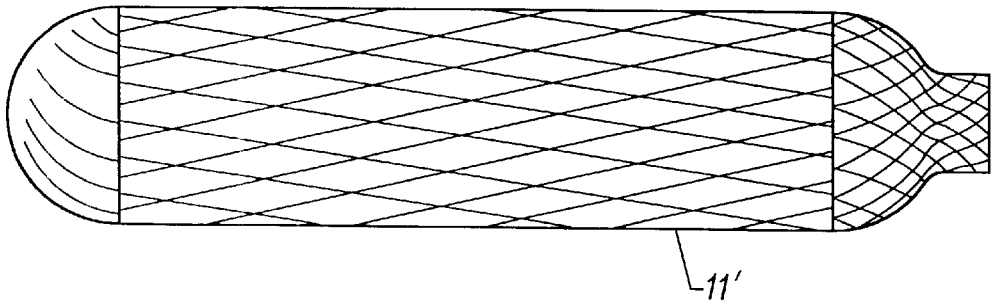
FIG. 9 shows an alternative fiber and resin gas cartridge for the avalanche life jacket of the present invention.

The gas cartridge 11 may be made of any suitable material which is gas impermeable, can withstand a relatively high pressure, for example, approximately 2500–3500 psi and preferably rust-proof. Gas cartridge 11 is typically made of steel, aluminum or Kevlar™. Alternatively, as shown in FIG. 9, gas cartridge 11' may be composites comprising of fibers (such as glass, aromides, Kevlar™, carbon, graphite) and resins (such as epoxy and polyester), which results in a smaller, reinforced cartridge.

Figure 10:
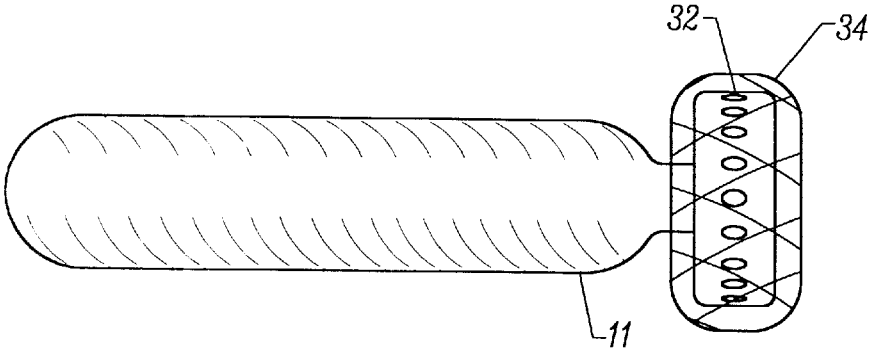
FIG. 10 shows another alternative of the cartridge with a vortex for the avalanche life jacket of the present invention.
Figure 11:
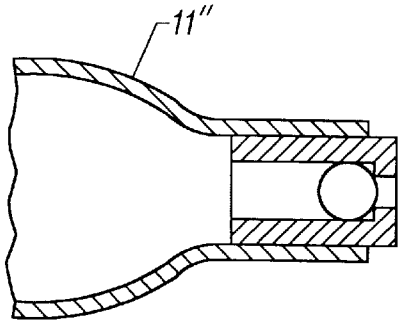
FIG. 11 shows yet another alternative ball and lock cartridge for the avalanche life jacket of the present invention.

Gas cartridge 11 or gas release system 10 may further comprise a pressure sensor 40 with a one-way valve in gaseous communication with airbag 8 and with the environment to prevent over-pressurization (e.g. over 1 to 3 atmospheres) of airbag 8 during inflation and/or use. Further, as shown in FIG. 10, a vortex-effect member 32 may be coupled to gas cartridge 11 to ease inflation of airbag 8. Gas cartridge 11 may be a two-stage gas release system, where gas cartridge 11 inflates airbag 8 in the first stage and maintains airbag 8 at approximately a predetermined pressure thereafter in the second stage. Gas cartridge 11 may be a single use or a rechargeable and reusable cartridge. The user may also carry one or more additional gas cartridges 11 for an additional supply of gas. As shown in FIG. 11, a rechargeable gas cartridge 11" may comprise a metal ball and a metal ball valve to provide a gas tight seal.

Figure 12:
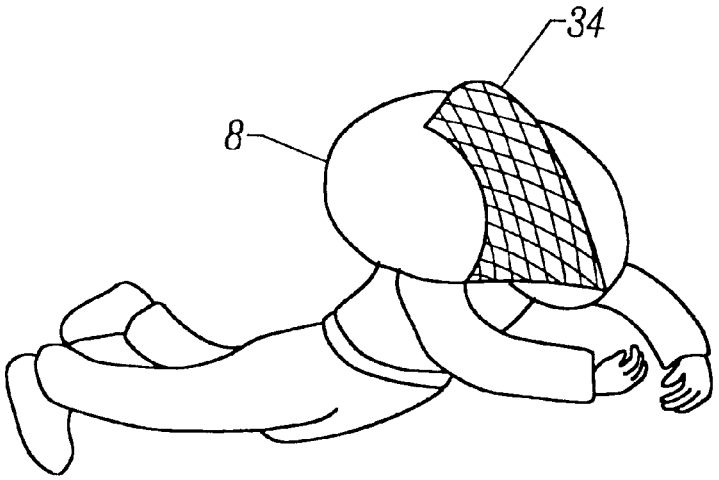
FIG. 12 shows a user wearing an inflated avalanche life jacket of the present invention in snow with a protective mesh.

As shown in FIG. 12, after inflation, airbag 8 tightly surrounds at least the back and sides of the user's head. Even after inflation of airbag 8, jacket 50 remains firmly attached to the user via torso strap 5 to ensure maximum protection provided by jacket 50. Inflated airbag 8 thus protects at least the user's head from injuries due to falls, rocks, ice, snow, etc. during an avalanche or a fall. Airbag 8 may be shaped such that inflated airbag 8 provides support under the user's chin to prevent excessive bending of the user's neck and thereby reduces the risk of neck injuries. In addition, during an avalanche, inflated airbag 8 may provide a buoyant force against the downward pulling force exerted by the current of the avalanche on the user. Thus, inflated airbag 8 would decrease the chance of or the extent to which the user may be buried under the snow.

During and after an avalanche, jacket 50 with inflated airbag 8 provides a buffer around the user's head to protect the user's head from falls, rocks, ice, snow, etc. To further protect the user's head and, optionally, the neck, jacket 50 preferably provides hood or thin mesh 34 over the user's head upon inflation of airbag 8. Hood or thin mesh 34 also provides a volume in front of the user's face which is free of snow and thus further protects the user from suffocation. Preferably, hood or thin mesh 34 is elastic to allow airbag 8 to automatically pull hood 34 over the user's head during inflation. Alternatively, the user may manually pull hood or mesh 34 over his/her head. Hood or mesh 34 may be disposed at gas cartridge 11 (as shown in FIG. 10) and/or attached to either harness 1 or airbag 8.

To ensure that no or a minimal amount of snow enters the area defined by inflated airbag 8 and hood or mesh 34, airbag 8 preferably provides a lip (not shown), which upon inflation encircles the user's neck. Be encircling the user's neck, lip of airbag 8 facilitates in preventing snow from entering the area around the user's head and thus further facilitates in preventing the user from suffocating during an avalanche.

Referring again to FIG. 8, harness 1 may further provide a gas port or mouth-bite 12 coupled to airbag 8 to allow the gas to exit from airbag 8. Mouth-bite 12 may be one typical of those on life jackets such as those sold by Hakley-Roberts, of Saint-Paul, Fla. Mouth-bite 12 is sealingly coupled to airbag 8 via an opening (not shown). With the provision of mouth-bite 12, inflated airbag 8 may also serve as a respiratory chamber providing up to approximately 80–150 liters of gas, and preferably approximately 100 liters of gas. This volume of breathable gas preferably provides approximately 15 to 20 minutes of breathing time. Life jacket 50 may also provide extra gas cartridges 11 to replenish the supply of breathable gas within airbag 8. The user may breathe the gas contained in inflated airbag 8 through mouth-bite 12 if the gas is a breathable gas such as air or oxygen-enriched air.

Mouth-bite 12 preferably provides a depressible one-way valve with an open and a closed position. Preferably, mouth-bite 12 is automatically in the open position by default upon inflation of airbag 8. The user may depress the depressible valve of mouth-bite 12 to switch mouth-bite 12 from the open to the closed position to prevent gas from exiting from airbag 8. In addition, mouth-bite 12 is preferably disposed such that as the gas exits through mouth-bite 12 from airbag 8, the exiting gas is urged into the nose or mouth of the user. Thus, with mouth-bite 12 in the default open position, an unconscious user may be forced to breathe the gas exiting through mouth-bite 12 from airbag 8.

Mouth-bite 12 also allows the user to selectively release the gas from airbag 8 to completely or partially deflate airbag 8. For example, if the user is trapped under the snow after an avalanche, the user may partially or fully deflate airbag 8 via mouth-bite 12. Deflating airbag 8 results in a volume of space without snow around the user. Such a volume of space would provide maneuverability to the user and thus facilitate the user in digging out in order to escape from under the snow. After deflating airbag 8, the user may easily store deflated airbag 8 by folding airbag 8, returning folded airbag 8 into harness 1 and closing enclosure mechanism 16.

Jacket 50 may further comprise additional features or components to facilitate search and rescue efforts after an avalanche. For example, airbag 8 may be brightly colored so that an inflated airbag 8 may be easily seen and detected. Airbag 8 may also be coated with a thin film of a material, such as aluminum, to facilitate locating the user in a radar search. In addition, jacket 50 may further emit, for example, an environmentally biocompatible color dye, such as a dye which is fluorescent and/or reflective. The color dye is emitted during inflation of airbag 8 such that the color dye would be spread into the snow adjacent the user during an avalanche to thereby facilitate locating the user in a visual search. Two or more colors of dye, at least one of which is preferably fluorescent and/or reflective, may be provided such that inflation of airbag 8 during an avalanche would result in a multi-colored snow trail. This would further facilitate a visual search for the user as the colored trail would comprise portions of distinct colors and portions of a more evenly mixed color. Jacket 50 may additionally or alternatively emit an environmentally biocompatible scent or odor during inflation of airbag 8. The odor would be released into the environment adjacent the user during an avalanche to thereby facilitate locating the user in a dog and nose search.

As discussed above, the use of the avalanche life jacket 50 of the present invention, for example, in an avalanche, provides several advantageous functions to the user which may increase the user's chances for survival during and after an avalanche and may also facilitate the search and rescue for the user. The above-noted advantageous functions of the avalanche life jacket 50 for survival, search and rescue would easily be applicable to or adapted to be applicable to other uses of jacket 50. Examples include but are not limited to mountaineering activities as well as situations involving water, crevasses and/or glaciers.

In addition, all or a portion of the components of avalanche life jacket 50 may be integrated into, rather than merely attached to, a vest, a backpack and/or another jacket. For example, an integrated avalanche apparatus may have integrated therein all or a portion of airbag 8. Alternatively or additionally, some operations, such as attachment of the integrated avalanche apparatus to the user, actuation of gas release system 10 may be integrated into, for example, a vest or backpack. However, such integration of components of jacket 50 into an integrated avalanche apparatus may result in a decrease in versatility and adaptability of jacket 50, which, without integration, may be freely and easily attached to the user for winter or summer use, and/or to a vest or backpack.

Figure 13A:
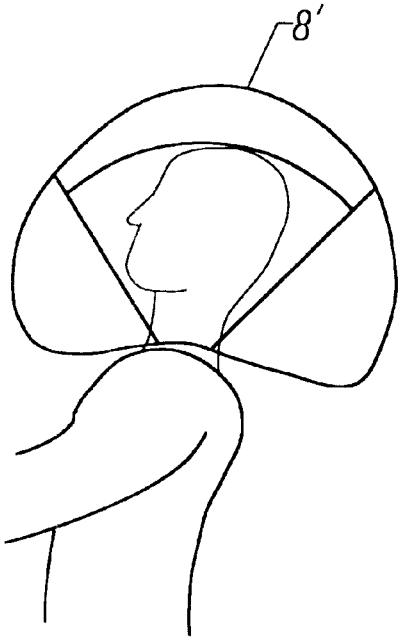
FIGS. 13A and 13B show alternative configurations for the airbag of the avalanche life jacket of the present invention.
Figure 13B:
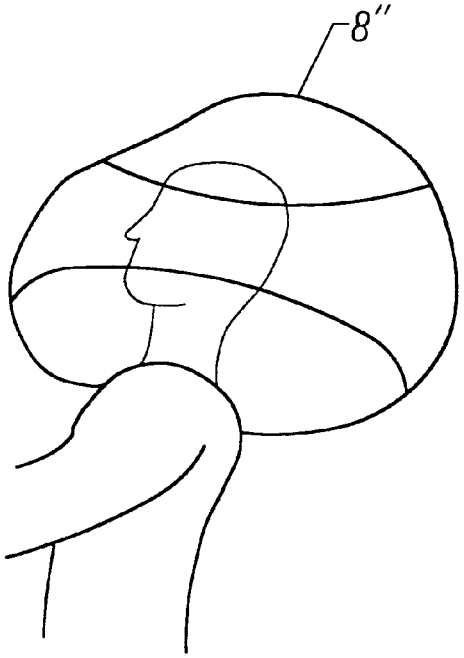

Other embodiments of jacket 50 may be easily adapted by one of ordinary skill in the art. For example, as shown in FIGS. 13A and 13B, airbag 8' or 8" may comprise two or more compartments, rather than a single compartment, for enclosing the gas. Each of the multiple compartments may provide a baffle or one-way valve adapted for gaseous communication with another compartment. The baffle or one-way valve enables gas cartridge 11 to inflate each compartment while a leak or a break in any other compartment would not affect or otherwise deflate another compartment.

Airbag may be a multi-piece construction or a single piece construction (not shown). In addition, the symmetrical design of jacket 50 may be altered to be asymmetrical (also not shown), for example, by locating gas cartridge 11 at a side of jacket 50 rather than centrally located relative to jacket 50. Other embodiments are easily adapted so long as the pieces are assembled together, glued, welded or otherwise attached by any suitable mechanism to provide a volume around the head of the user.

Although various embodiments of the invention have been described, the descriptions are intended to be merely illustrative. Thus, it will be apparent to those skilled in the art that modifications may be made to the embodiments as described without departing from the scope of the claims set forth below.

What is claimed is:

1. An inflatable life jacket comprising:

a harness attachable to a user;

an inflatable airbag comprising at least one compartment and being encloseable within said harness prior to inflation, wherein upon inflation said airbag tightly surrounds at least a portion of the head of the user;

a gas release system in gaseous communication with said at least one compartment of said airbag, said gas release system being capable of inflating said airbag; and an actuator for actuating said gas release system.

2. The inflatable life jacket of claim 1, wherein upon inflation, said airbag further surrounds at least a portion and supports the neck of the user.

3. The inflatable life jacket of claim 1, wherein said actuator comprises a release mechanism for manual actuation of said gas release system.

4. The inflatable life jacket of claim 3, further comprising an actuation preventer coupled to said actuator to selectively prevent manual actuation of said gas release system.

5. The inflatable life jacket of claim 3, wherein said actuator comprises an accelerometer capable of automatic actuation of said gas release system upon indication of a predetermined threshold acceleration.

6. The inflatable life jacket of claim 5, wherein said actuator further comprises a switch for selectively switching between at least two positions, said positions selected from the group consisting of a first position for preventing actuation of said gas release system, a second position for manual actuation, a third position for automatic actuation, and a fourth position for manual and automatic actuation.

7. The inflatable life jacket of claim 1, further comprising a gas port in gaseous communication with said airbag for selectively allowing gas to escape from said airbag.

8. The inflatable life jacket of claim 1, wherein said gas release system comprises a pressurized gas cartridge for inflating said airbag.

9. The inflatable life jacket of claim 8, wherein said cartridge contains a pressurized gas selected from the group consisting of air, nitrogen, oxygen, sodium oxide, hydrogen and mixtures thereof.

10. The inflatable life jacket of claim 1, wherein said harness comprises an airbag enclosure mechanism for enclosing said airbag in said harness prior to inflation of said airbag, said airbag enclosure mechanism being capable of opening during inflation of said airbag to allow expansion thereof outside of said harness.

11. The inflatable life jacket of claim 1, further comprising a hood coupled to said harness capable of being disposed over the user's head to provide protection thereto.

12. A life jacket, comprising:

an inflatable airbag comprising at least one compartment;

an enclosure for attachment to a user, said enclosure adapted to enclose said airbag prior to inflation thereof, wherein upon inflation said airbag is disposed tightly around at least a portion of the head of the user; and an actuatable gas introducer in gaseous communication with said at least one compartment of said airbag, wherein upon actuation, said introducer introduces a gas into said airbag to inflate it.

13. The life jacket of claim 12, wherein upon inflation, said airbag further surrounds at least a portion and supports the neck of the user.

14. The life jacket of claim 12, wherein said gas introducer is manually actuatable by a release device upon manipulation thereof.

15. The life jacket of claim 14, wherein said release device is coupled to said gas introducer via a cable.

16. The life jacket of claim 12, wherein said gas introducer is automatically actuatable by an accelerometer upon said accelerometer registering a predetermined threshold acceleration.

17. The life jacket of claim 12, wherein said gas introducer comprises an actuation preventer for selectively preventing actuation of said introducer.

18. The life jacket of claim 12, wherein said gas introducer is manually actuatable by a release device upon manipulation thereof, said gas introducer is automatically actuatable by an accelerometer upon said accelerometer registering a predetermined threshold acceleration, said life jacket further comprising a toggle for selectively switching between at least two positions, said positions selected from the group consisting of an off position for preventing actuation of said introducer, a manual actuation position, an automatic position, and a manual and automatic position.

19. The inflatable life jacket of claim 12, further comprising a pressure sensor in gaseous communication with said airbag, said pressure sensor includes a one-way valve adapted for selectively allowing gas to escape from said airbag.

20. The inflatable life jacket of claim 12, wherein said gas introducer comprises a pressurized gas cartridge for inflating said airbag.

21. The inflatable life jacket of claim 20, wherein said cartridge contains a pressurized gas selected from the group consisting of air, nitrogen, oxygen, sodium oxide, hydrogen and mixtures thereof.

22. The inflatable life jacket of claim 12, wherein said container comprises an airbag enclosure mechanism for enclosing said airbag in said container prior to inflation of said airbag, said airbag enclosure mechanism being capable of opening during inflation of said airbag to allow expansion thereof outside of said container.

23. The inflatable life jacket of claim 12, further comprising a port in gaseous communication with said airbag and adapted to selectively urge the gas toward the nose or mouth of the user.

24. The inflatable life jacket of claim 23, further comprising a mouth bite in gaseous communication with said port.

25. The inflatable life jacket of claim 12, wherein said airbag is coated with a radar-detectable material.

26. The inflatable life jacket of claim 12, further comprising at least one dye introducer attached to at least one of said airbag and said enclosure, said dye introducer being adapted to discharge a dye upon actuation of said actuatable gas introducer.

27. The inflatable life jacket of claim 26, wherein said dye is at least one of a fluorescent dye and a reflective dye.

28. The inflatable life jacket of claim 12, further comprising at least one scented gas introducer attached to at least one of said airbag and said enclosure, said scented gas introducer being adapted to discharge a scented gas upon actuation of said actuatable gas introducer.

29. The life jacket of claim 1, wherein at least the back and sides of the head of the user are tightly surrounded.

30. The life jacket of claim 12, wherein at least the back and sides of the head of the user are tightly surrounded.

* * * * *